US005421276A

United States Patent [19]

Hooper, Jr.

[11] Patent Number: 5,421,276

[45] Date of Patent: Jun. 6, 1995

[54] METHOD OF DISPOSING OF ABSORBENT MATERIAL IMPREGNATED WITH WASTE

[76] Inventor: William C. Hooper, Jr., 1411 Wood Hollow Dr. #34101, Houston, Tex. 77057

[21] Appl. No.: 990,466

[22] Filed: Dec. 15, 1992

[51] Int. Cl.[6] ..... F23G 7/00; B02C 23/36

[52] U.S. Cl. ..... 110/346; 110/342; 110/347; 241/2; 241/DIG. 38

[58] Field of Search ..... 110/346, 235, 342, 347, 110/263, 243; 241/2, 21, 23, 29, 43, 152.2, DIG. 38

[56] References Cited

U.S. PATENT DOCUMENTS

| | | | |
|---|---|---|---|
| 1,507,605 | 9/1924 | Howe et al. | 241/29 |
| 2,316,005 | 4/1943 | Lachle | 260/428 |
| 3,464,635 | 9/1969 | Krzewinski et al. | 241/21 |
| 3,871,291 | 3/1975 | Lassiter | 241/23 X |
| 3,951,581 | 4/1976 | Nakayama et al. | 110/346 X |
| 3,991,689 | 11/1976 | Rinecker | 110/8 P |
| 4,017,033 | 4/1977 | Trä | 241/29 X |
| 4,099,473 | 7/1978 | MacKenzie et al. | 110/219 |
| 4,113,185 | 9/1978 | Marsh et al. | 241/21 |
| 4,365,761 | 12/1982 | Danforth | 241/21 |
| 4,715,300 | 12/1987 | Costeb et al. | 110/346 |
| 4,728,044 | 3/1988 | Duill et al. | 241/23 X |
| 4,905,614 | 3/1990 | Grigel et al. | 110/346 |
| 5,104,047 | 4/1992 | Simmons | 241/20 |

*Primary Examiner*—Henry A. Bennet
*Assistant Examiner*—William C. Doerrler
*Attorney, Agent, or Firm*—Vaden, Eickenroht, Thompson & Feather

[57] ABSTRACT

Method for disposing of absorbent material impregnated with waste. The capillary retention capability of the absorbent material impregnated with waste is destroyed, thereby releasing the waste retained in the material. The absorbent material and released waste form a mixture for disposal at a boiler, industrial furnace or incinerator.

14 Claims, No Drawings

METHOD OF DISPOSING OF ABSORBENT MATERIAL IMPREGNATED WITH WASTE

BACKGROUND OF THE PRESENT INVENTION

1. Field of the Invention

The present invention relates generally to methods for disposing of hazardous and non-hazardous waste. More particularly, the present invention relates to a method for disposing of absorbent material impregnated with waste, wherein the absorbent material is processed to release the waste so that it disperses and mixes with the material to form a mixture that may be disposed of in an industrial furnace or incinerator.

2. Description of the Prior Art

As environmental regulations for the transporting, storing and disposing of hazardous and non-hazardous waste become more stringent, it is increasingly important that methods for their effective and safe disposal be found. The disposal of many wastes is complicated in light of decreasing landfill space availability and the increasing demands on waste containment facilities. Even though greater efforts are being made toward the minimization of waste production, the demand for competent waste disposal methods and facilities continues to increase. Such demands on current disposal methods and facilities will likely continue to increase as more compounds are classified by the United States Environmental Protection Agency.

Wastes which are "bulky" in character place a particular burden on waste transportation, disposal, and facilities due to the inherent nature of such wastes to require increased handling efforts and increased disposal space. Bulky wastes include absorbent materials such as cloths, rags, paper and sponges. Many of these materials will also be fibrous. Such materials are used in a variety of industrial applications, such as cleaning of equipment, use with solvents or other chemicals, and wiping up spills of oil, paints, and other liquids. The absorbent materials, particularly industrial cloths, may be used to absorb or clean up gross hazardous or non-hazardous waste spills. Once a hazardous waste is absorbed into the material, it is often itself classified as hazardous waste.

Altering the physical characteristics of bulky wastes, such as the absorbent materials described above, can facilitate the transportation and disposal of such wastes. Several methods are currently employed for the reuse or disposal of absorbent materials, particularly used industrial cloths and rags, which have become impregnated with waste. In some instances, the rags are washed to remove the waste absorbed into them. The rags can then be re-used in industrial and other operations. However, this method is undesirable because of the increased handling of the used rags required during the cleaning process. Furthermore, the rags and cloths may be impregnated with waste which is listed by the United States Environmental Protection Agency as hazardous or which exhibits hazardous characteristics. Thus, the wash/waste mixture extracted during the cleaning process may itself have to be disposed of pursuant to environmental regulations. There is also some question as to the effectiveness of the cleaning process. Washing rags or cloths containing waste may not eliminate all residues, and workers may be exposed to such residues when the rags are reused. Rags, cloths and sponges impregnated with waste may also be mechanically "wrung-out" to remove the waste from the material. However, this method is subject to the same undesirable results as experienced when the rags or cloths are washed.

Industrial rags, cloths and other absorbent materials impregnated with waste may also be disposed of using biodegradation methods. The waste-impregnated absorbent materials are disposed of at containment facilities in the presence of microbes which biodegrade the materials and the waste. The process requires a long period of time, and a substantial amount of labor during the biodegradation process.

The primary method for disposing of waste-impregnated industrial rags and cloths has been to place them in landfills, or to incinerate them by traditional incineration methods or burn them in boilers or industrial furnaces ("BIF"). The waste absorbed into the rags or cloths may possess potentially high heat generating (BTU) values, and the rags and cloths themselves frequently have a high BTU content. The rags and cloths impregnated with wastes having high BTU values provide advantageous and economical fuel for various industrial purposes, such as use in BIFs.

Fuel flow requirements for incinerators and BIFs are often critical, and necessitate maintaining continuous optimum uniform temperature values, depending on the amount of heat required. Optimum combustion efficiency can be achieved by feeding an incinerator or BIF a continuous flow of a waste mixture. Therefore, the mixture should be of a consistency that can be steadily and evenly fed or pumped into the incinerator or BIF.

Absorbent materials have been chopped or shredded at disposal or blending sites prior to feeding the materials into an incinerator or BIF. However, chopping or shredding absorbent materials produces a product of uneven consistency which does not readily feed into a BIF. A steady stream of waste material is desirable for accomplishing complete combustion and temperature maintenance within a BIF.

Shredded absorbent material may be blended with water or other liquids to facilitate feeding material continuously into an incinerator or BIF. For example, shredded rags or other absorbent material, may be blended with hazardous liquids having high BTU values. The high-BTU liquids enable blending, and provide the temperature values necessary for efficient and complete combustion of the materials in the incinerator or BIF. However, the course nature of the blended mixture makes the mixture difficult to handle and manipulate. Further, the pieces of material tend to settle out of the blended mixture when feeding the mixture into an incinerator or BIF.

Difficulties experienced with disposing of absorbent materials impregnated with waste were partially addressed by Costello et al., U.S. Pat. No. 4,715,300, dated Dec. 29, 1987. Costello et al. provided a method of disposing of waste-impregnated materials, primarily industrial rags and cloths, by dissolving the materials in acid and then incinerating the acid mixture. Preferably, the acid mixture would be incinerated in the incinerator of an acid regeneration plant. Although the method revealed by Costello et al. produced a slurry or nearly liquid product capable of being fed to an incinerator, the materials impregnated with waste must be acid-dissolvable. Further, preparation of the mixture and the subsequent handling of the acid mixture requires substantial labor and safety controls.

It is therefore an object of this invention to provide an improved method of disposing of absorbent materials impregnated with waste which overcomes these and other problems with prior methods for this purpose.

SUMMARY OF THE INVENTION

In accordance with the present invention, a method of disposing of absorbent material which has been impregnated with waste is provided. The inventive method may be used to dispose of absorbent material impregnated with waste, such as rags, cloths, sponges, pads, socks, sweeps, peat moss, paper, cork, and clay, in an environmentally-safe manner. The absorbent material may be shredded or crushed prior to destruction of capillary retention capability. The capillary retention capability of the waste-impregnated material is destroyed, thereby releasing the waste retained in the material. In a preferred embodiment of the invention, a wet comminution machine is used to destroy capillary retention capability of the absorbent material. The released waste disperses and mixes with the material, forming a slurry-like mixture. Water or other liquids may be added to adjust the heat content or viscosity of the mixture, if necessary. The mixture may then be transported and handled in bulk liquid form. Preferably, the mixture formed by the absorbent material and waste is burned in an industrial furnace or boiler as a fuel, or incinerated.

DETAILED DESCRIPTION OF THE PRESENT INVENTION

The present invention is applicable to materials which attract and retain liquids by capillary retention, and are generally referred to as absorbent. The materials contemplated by the invention are used in absorbing, wiping up, or cleaning-up a waste. Examples of such absorbent materials include industrial and non-industrial rags and/or cloths, sponges, pads, socks, sweeps, peat moss, paper, cork, and clay. The absorbent materials may consist of natural, synthetic or a combination of natural and synthetic fibers or substances. Frequently, absorbent materials selected for the described uses will be fibrous.

The absorbent materials are used to wipe- or soak-up spills of oil, paints, chemicals, or other hazardous or non-hazardous waste. Absorbent materials are used to retain gross chemical and oil spills on soil or water. The materials may also be used with cleaning solvents in cleaning processes and for degreasing or maintaining equipment in industrial and non-industrial operations, as well as have numerous other uses and applications.

When used in the manners described, the absorbent materials become impregnated with waste. Generally, once the absorbent material is impregnated with a particular waste, it must be handled and disposed of consistent with regulations concerning the waste. The present invention offers a method for disposal of the waste-impregnated absorbent materials in a manner which minimizes the environmental impact of waste disposal.

In a preferred embodiment of the present invention, a self-contained mobile unit consisting of a drop deck container frame trailer is outfitted with an IMO Type 1 ISO tank, and a machinery module containing a bulk shredder, a mixing/separation tank, hydro-cyclone system, grinder pump, and at least one wet comminution machine. Used rags or cloths, or other absorbent materials impregnated with waste, will be processed for disposal at the generator's site or where the material is used. Alternatively, the used absorbent material may be picked up from the site where the material is used and transported to where the described machinery is located. Waste-impregnated material is then subjected to a series of size-reduction processes in the mobile unit. In another embodiment, the inventive method is practiced utilizing the described machinery wherein the machinery is stationary and not affixed to a trailer for mobility.

During operation, the bulk shredder and its associated pumping/augering equipment is placed at ground level. The waste-impregnated absorbent material is loaded into the bulk shredder, which will reduce the size of the material to a suitable size for handling in a bulk liquid system. In a preferred embodiment, the material is reduced to approximately one inch by one inch or smaller pieces during shredding. The reduced size also facilitates the subsequent grinding of the material in the wet comminution machine. Alternately, a high torque, low speed shredder can be utilized if the absorbent material contains debris or trash. A bulk shredder that may be utilized with the inventive method is an O&E Machine Corporation SW-40L shredder.

The shredded material is moved into the mixing-/separation tank by the pump and augering equipment. The shredded material can be recirculated through the shredder for additional shredding if additional particle size reduction is desired. The material is recirculated through the shredder by pumping already shredded material from the mixing/separation tank to the intake area of the shredder.

The mixing/separation tank will contain a settling system and magnetic system to capture dense material such as steel shavings and rocks. A grinder pump, such as the ARDE 10X6, or similar grinder pump, will continually circulate shredded material in the mixing/shredding tank. The grinder pump will also provide a stream of material to a hydro-cyclone system. The bottom flow from the hydro-cyclone system is returned to the mixing/separation tank, and will contain dense material such as steel or rocks which were not previously captured, and/or large particle size material. The vortex material from the hydro-cyclone system is fed to the wet comminution machine. A series 'C' Cyclone manufactured by Warman may be utilized with the present invention.

The wet comminution machine grinds the pieces of material to small particles, thereby destroying the capillary retention capability of the waste-impregnated absorbent material. When capillary retention is destroyed, the waste absorbed into the material is released, and a mixture of material and waste is formed. The mixture may be wet comminuted through a second comminution machine or, alternatively, recirculated through the same wet comminution machine, to further mix the waste and material and destroy any remaining capillary retention capability of the material. A wet comminution machine that may be utilized with the present invention is a Siefer Trigonal ®-Machines Type SM 290.

Following wet comminution, the material and waste mixture is pumped into the ISO storage tank for hauling to the appropriate disposal entity. The mixture is suitable for burning for energy recovery and may be used as waste fuel at an industrial furnace or a boiler, thereby providing a means of waste reduction and recycling. The mixture may also be disposed of by incineration. The absorbent material/liquid mixture will have a uniform consistency and is readily pumpable into a BIF or incinerator.

In an alternate embodiment, a hammermill is used to initially reduce the size of the waste-impregnated absorbent material prior to wet comminution. The crushing action hammermill initially reduces the absorbent material by crushing the material to fines and pieces. The hammermill will be more advantageous for the processing of nonfibrous absorbent materials, such as cork, clays, silicates, or similar absorbent substances, than the shredder. However, it will be equally advantageous to use the hammermill with fibrous absorbent materials such as cloth, sponge, and paper. A 20 Series Crusher manufactured by American Pulverizer Company may be utilized with the present invention.

Following crushing in the hammermill, the absorbent material is deposited into the mixing/separation tank. The mixture may be recirculated through the hammermill before being pumped through the hydro-cyclone system where dense materials will be separated from the waste-impregnated absorbent material, as described above. The vortex material from the hydro-cyclones is fed to the wet comminution machine whereby the capillary retention capability of the material is destroyed.

In another embodiment, an attritor is utilized to destroy the capillary retention capability of the waste-impregnated absorbent material. Following crushing in the hammermill, the material is deposited into the mixing/separation tank. The material may be recirculated through the hammermill, mixing/separation tank, and hydro-cyclone system as described above. The vortex material is then fed to the ISO tank. The ISO tank material is circulated through an attritor which grinds the material to break down the capillary retention capability of the material. The material and waste mixture is then transported to the appropriate disposal entity. An attritor which may be utilized with the inventive method is a Union Process Attritor Type Q-25.

Destroying the capillary retention capability of the waste-impregnated absorbent material allows any waste absorbed or impregnated into the material to be released. Some of the waste will begin to be released as a result of the initial shredding or hammermilling, however, it is the extensive destruction of the capillary retention capability of the absorbent material by the comminution machine or attritor which enables release of all the waste retained in the material. The waste released and the absorbent material form a mixture ideal for disposal in a boiler or industrial furnace.

Depending upon the heat producing ability of the liquids impregnating the absorbent material. Water or other liquids or waste may be added to the mixture to adjust the heat content or viscosity of the mixture. Additional liquid may also be added to ensure a uniformed dispersion of the solids in the comminution machines.

Since the inventive method allows for the adding of liquid other than that released from the absorbent material, the inventive method enables the disposal of additional waste available at a waste generator's site. The additional liquids may also be added to the mixture when it is in the storage tank. Frequently, the waste will contain a relatively high BTU value and is, therefore, desirable for use as a source of a waste-derived fuel. The added waste may be hazardous or nonhazardous waste in liquid form. When the waste is added to the mixture, it can then be disposed of with the mixture at a BIF or incinerator.

The present invention has been described in terms of specified embodiments which are set forth in detail. The embodiments specifically disclosed herein are illustrative of the present invention and the invention is not limited thereto. Alternative embodiments will become apparent to those skilled in the art upon review of the disclosure, and such alternate embodiments are contemplated which do not depart from the focus of the present invention.

What is claimed is:

1. A method of disposing of absorbent material impreganated with a waste in liquid form comprising the steps of:

(a) mechanically reducing the absorbent material to a size which will destroy the capillary retention capability of the absorbent material, and thereby releasing the waste in liquid form impregnated in the absorbent material from the absorbent material;

(b) forming a mixture of the absorbent material and waste released from the absorbent material; and (c) disposing of the mixture.

2. The method of claim 1, wherein the absorbent material is selected from the group consisting of rag, cloth, paper, sponge, pads, socks, sweeps, and peat moss, cork, clay and silicate.

3. The method of claim 1, wherein the absorbent material impregnated with a waste in liquid form is reduced in size prior to destroying the capillary retention capability.

4. The method of claim 3, wherein the absorbent material impregnated with a waste in liquid form is shredded prior to destroying the capillary retention capability.

5. The method of claim 3, wherein the absorbent material impregnated with a waste in liquid form is crushed prior to destroying the capillary retention capability.

6. The method of claim 1, wherein destruction of the capillary retention capability of the absorbent material impregnated with a waste in liquid form is performed in a wet comminution machine.

7. The method of claim 1, wherein liquid is added to the mixture.

8. The method of claim 1, wherein water is added to the mixture.

9. The method of claim 1, wherein waste in the form of a liquid is added to the mixture.

10. The method of claim 1, wherein the mixture is transportable in bulk liquid form.

11. The method of claim 1, wherein the mixture is disposed of by burning as a fuel.

12. The method of claim 1, wherein the mixture is disposed of by burning as a fuel in an industrial furnace.

13. The method of claim 1, wherein the mixture is disposed of by burning as a fuel in a boiler.

14. The method of claim 1, wherein the mixture is incinerated.

* * * * *